US011262704B2

(12) United States Patent
Finck

(10) Patent No.: US 11,262,704 B2
(45) Date of Patent: Mar. 1, 2022

(54) WATCH CASE, WRISTWATCH AND WRISTWATCH ASSEMBLY KIT COMPRISING IT

(71) Applicant: ETA SA Manufacture Horlogere Suisse, Grenchen (CH)

(72) Inventor: Didier Finck, Rantzwiller (FR)

(73) Assignee: ETA SA Manufacture Horlogere Suisse, Grenchen (CH)

( * ) Notice: Subject to any disclaimer, the term of this patent is extended or adjusted under 35 U.S.C. 154(b) by 839 days.

(21) Appl. No.: 16/104,166

(22) Filed: Aug. 17, 2018

(65) Prior Publication Data

US 2019/0079457 A1 Mar. 14, 2019

(30) Foreign Application Priority Data

Sep. 8, 2017 (EP) ..... 17190168

(51) Int. Cl.

| | |
|---|---|
| ***G04B 37/00*** | (2006.01) |
| ***G04B 37/14*** | (2006.01) |
| ***A44C 5/00*** | (2006.01) |
| ***A44C 5/14*** | (2006.01) |

(52) U.S. Cl.

CPC ..... *G04B 37/0008* (2013.01); *A44C 5/0053* (2013.01); *A44C 5/14* (2013.01); *G04B 37/1486* (2013.01)

(58) Field of Classification Search

CPC .... G04B 37/0008; G04B 37/1486; A44C 5/14
See application file for complete search history.

(56) References Cited

U.S. PATENT DOCUMENTS

| | | | | |
|---|---|---|---|---|
| 2,559,238 | A | 7/1951 | Wallin | |
| 3,585,794 | A | 6/1971 | Klingenberg | |
| 5,001,686 | A | 3/1991 | Triponez | |
| 2012/0111905 | A1* | 5/2012 | Bell | A44C 5/14 224/177 |

FOREIGN PATENT DOCUMENTS

| | | |
|---|---|---|
| CH | 124 791 | 3/1928 |
| CH | 513 453 | 4/1971 |
| DE | 103 05 305 A1 | 9/2004 |
| EP | 0 386 621 A1 | 9/1990 |
| JP | 63-99292 U | 6/1988 |

OTHER PUBLICATIONS

European Search Report dated Mar. 16, 2018 in European Application 17190168.9 filed on Sep. 8, 2017 (with English Translation of Categories of Cited Documents and Written Opinion).

* cited by examiner

*Primary Examiner* — Edwin A. Leon
*Assistant Examiner* — Jason M Collins
(74) *Attorney, Agent, or Firm* — Oblon, McClelland, Maier & Neustadt, L.L.P.

(57) ABSTRACT

A watch case for a wristwatch including a watch middle, at least one strut for supporting the watch middle, the strut extending beyond the space occupied by the watch middle, a device for removably attaching a watch strap to the strut. The watch case further includes a member for fixing the strut or one of the struts to the watch middle, the removable attachment device being formed when the strut is fixed to the watch middle, and the fixing member includes a device for detaching the strut from the watch middle, configured to allow release of the strut from the watch middle without using tools, the strut being removably fixed to the watch middle.

12 Claims, 3 Drawing Sheets

WATCH CASE, WRISTWATCH AND WRISTWATCH ASSEMBLY KIT COMPRISING IT

This application claims priority from European Patent Application No. 17190168.9 filed on Sep. 8, 2017, the entire disclosure of which is hereby incorporated herein by reference.

TECHNICAL FIELD OF THE INVENTION

The invention concerns a watch case for a wristwatch.

The invention also concerns a wristwatch comprising the watch case and a watch strap attached to the watch case.

The invention further concerns a wristwatch assembly kit, comprising the wristwatch and a plurality of watch straps.

PRIOR ART

In the field of mechanical or electromechanical wristwatches it is known to provide, for a watch case having a watch middle, at least one strut to support the watch middle.

A watch case of this kind is described for example in the patent application EP 0 386 621 A1. In that watch case, two struts to support the watch middle are arranged on respective opposite sides of the latter. The two struts extend beyond the space occupied by the watch middle to serve as means of attachment to a watch strap. To this end, two spring bars are fixed by their pivots in housings, generally formed by blind holes, arranged in facing faces of the ends of the struts, each of the bars being inserted in an eyelet provided at one end of each section of the watch strap. The two struts are permanently fixed to the watch middle, for example by screws. However, a disadvantage of the proposed watch case is that it does not allow the watch strap to be changed without using tools. It is in fact necessary, to change the watch strap, to act on the pivots of the spring bars using an appropriate tool, in order to retract them and to disengage them from their housings to separate the watch strap from the watch case.

In the patent application CH 513453 there is described a wristwatch having a frame, a watch strap the two ends of which are attached to the frame, and a watch case retained between the elements of the frame. To be more precise, the elements of the frame are constituted of two struts arranged on respective opposite sides of the watch middle of the watch case, and two members for fixing the struts to the watch strap. According to one particular embodiment of this wristwatch, the two members for fixing the struts to the watch strap are constituted of two screws that connect the struts at their ends, and each of which includes at one end a knurled head that projects externally of the struts. Each screw is inserted in an eyelet arranged in one end of a section of the watch strap, in order to fix the watch strap to the frame. By unscrewing the screws by means of their knurled heads, a user can separate all of the elements of the frame, and thus release the watch strap from the watch case. This therefore enables the watch strap or the watch case to be changed without using tools. However, demounting in this way involves action on each of the screws, i.e. two detachment operations in total. This complicates the operation of changing the watch strap. Moreover, once the screws have been removed, all the elements of the wristwatch are separated. This constitutes an additional disadvantage because of the risk of elements being dropped and breaking. The demounting operation is thus rendered laborious and somewhat impractical.

SUMMARY OF THE INVENTION

An object of the invention is therefore to provide a watch case for a wristwatch that allows the watch strap to be changed without using tools, in an easy and non-laborious manner, and alleviating the aforementioned disadvantages of the prior art.

To this end, the invention concerns a watch case for a wristwatch.

An advantage of this kind of watch case according to the invention resides in the fact that a strut to support the watch middle is removably fixed directly to the latter, and that the removable means for attaching the watch strap to the strut are formed when the strut is fixed to the watch middle.

Thanks to the means for detaching the strut, equipping a member for fixing the strut to the watch middle, a user can easily change the watch strap without using tools. In fact, conversely, since the means for removably attaching the watch strap to the strut are formed when the strut is fixed to the watch middle, the watch strap is detached very easily from the strut when the latter is detached from the watch middle. This single demounting operation is extremely simple for the user, who can then change the watch strap by detaching the initial watch strap from the strut or struts and replacing it with a new watch strap. The user can then change the watch strap of their wristwatch regularly, for example for aesthetic reasons or for convenience.

The means for removably attaching a watch strap to the strut advantageously comprise means for retaining the watch strap adapted to be inserted in an eyelet or a similar device provided in one end of a section of the watch strap. This makes it possible to facilitate the watch strap changing operation once the removable strut has been detached, by allowing easy releasing of the watch strap from the strut.

According to one particular embodiment of the invention, the watch case comprises two struts to support the watch middle, arranged on respective opposite sides of the watch middle; one of the two struts forming the strut removably fixed to the watch middle, the other strut being for example permanently attached to the watch middle.

Each strut advantageously has two L-shaped end portions, each L-shaped end portion of each strut forming one of said retaining struts and comprising a pin adapted to be inserted in an end section of the watch strap. This makes it possible to facilitate further the operation of changing the watch strap once the removable strut has been detached, by allowing easy release of the watch strap by simply sliding it along the pin at the end of the strut.

Again advantageously, each strut is in one piece with its L-shaped end portions. This makes it possible to facilitate the machining of the struts and to reduce the manufacturing cost of the latter.

The strut is advantageously mounted on one flank of the watch middle. This makes it possible to reduce the cost of machining the watch case.

To this end, the invention also concerns a wristwatch comprising the watch case described above, which has the features mentioned in claim 13.

One particular form of the wristwatch is defined in claim 14.

To this end, the invention also concerns a wristwatch assembly kit, comprising the wristwatch described above, and which has the features mentioned in claim 15.

BRIEF DESCRIPTION OF THE FIGURES

The aims, advantages and features of the watch case, as well as of the wristwatch and the assembly kit comprising it, will become more apparent in the following description based on at least one nonlimiting embodiment shown in the drawings, in which.

DETAILED DESCRIPTION OF THE INVENTION

Figure 1:
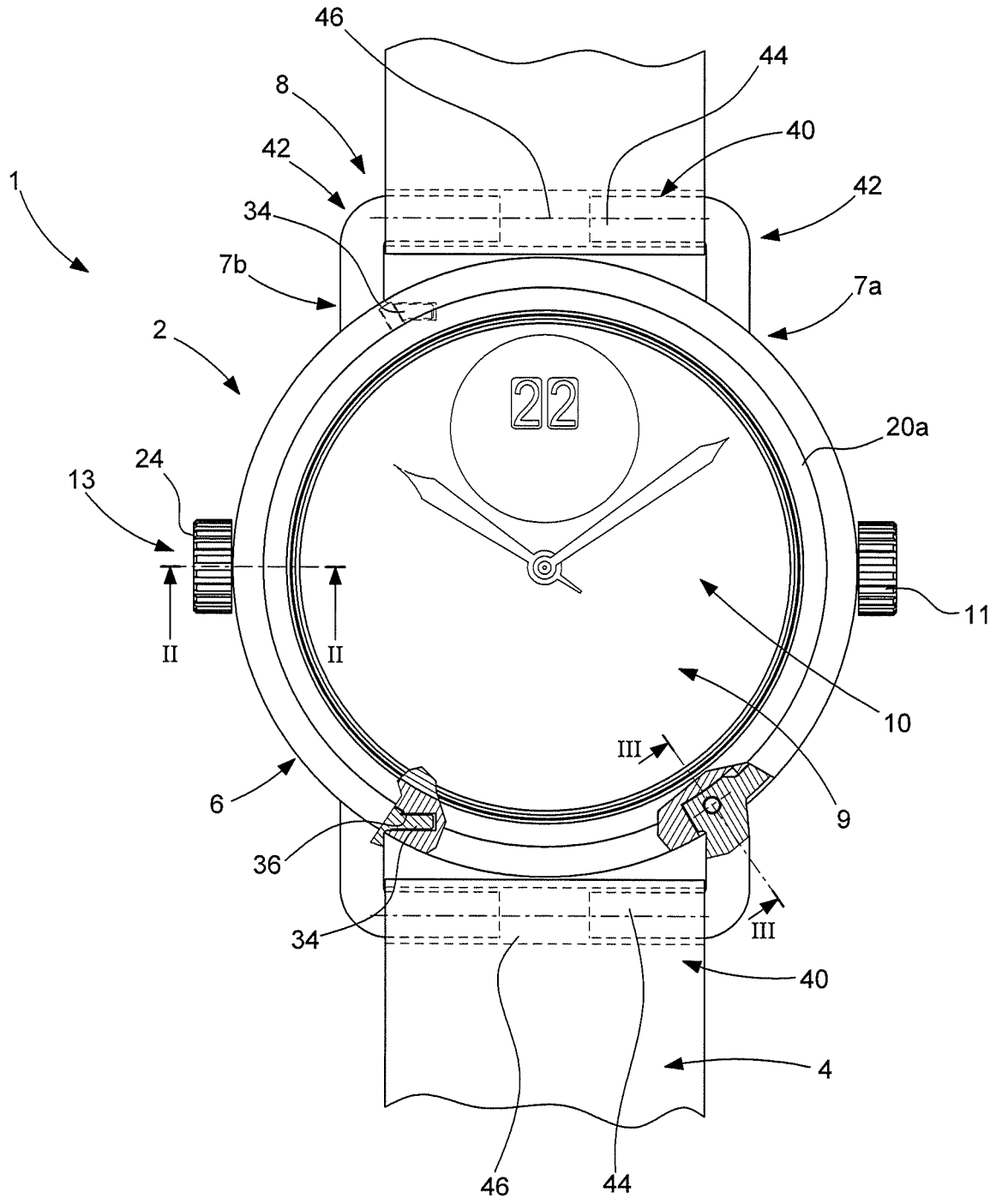
FIG. 1 is a plan view of a wristwatch that comprises a watch case according to the invention.

FIG. 1 represents a wristwatch 1, which comprises a watch case 2 and a watch strap 4 removably attached to the watch case 2. The wristwatch 1 may for example be part of a kit (not shown) further comprising one or more additional watch straps. Such additional watch straps constitute as many interchangeable watch straps for the wristwatch 1, and can be removably attached to the watch case 2. By way of nonlimiting example, the watch strap 4 and the additional watch straps may for example be constituted of articulated metal links, a plastic material or a flexible material such as leather.

In the remainder of the description, in a nonlimiting way, elements will be described as interior or exterior as a function of their orientation relative to the watch case 2.

The watch case 2 comprises a watch middle 6 and at least one support strut 7*a*, 7*b* of the watch middle 6. In the particular embodiment shown in FIGS. 1 to 4, the watch case 2 comprises two support struts 7*a*, 7*b*. The watch case 2 further comprises means 8 for removably attaching the watch strap 4 to the struts 7*a*, 7*b*, and a member 13 for removably fixing one of the struts 7*a*, 7*b* to the watch middle 6.

The watch case 2 encloses a movement (not shown) of standard construction, for example a mechanical movement of circular shape, as well as a dial 9 over which move display means formed of hands 10. The movement includes a winder crown wheel 11 that extends to the outside of the watch case 2, through an orifice formed in the watch middle 6.

As shown in the figures, the watch middle 6 is of annular shape and is closed at the bottom by a back 12 and by a crystal 18 the peripheral edge of which rests on an annular upper rim 16. The crystal 18 is for example a sapphire crystal. In the watch case 2 taken by way of example in FIGS. 1 to 4, the configuration of the watch case is substantially circular. However, the invention is in no way limited to this kind of configuration of the watch case, or to the other features described above of the watch middle 6.

Figure 2A:
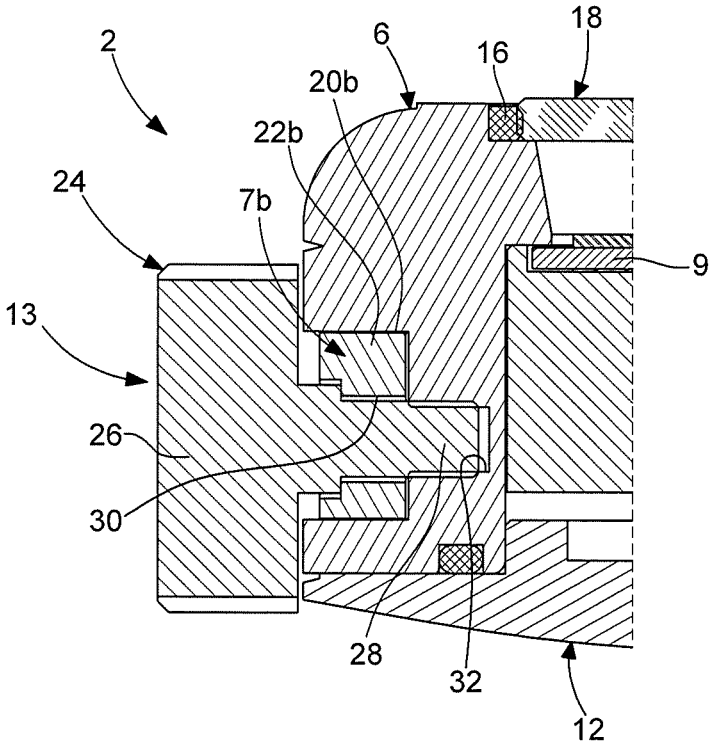
FIGS. 2*a* and 2*b* are views in section of a part of the watch case from FIG. 1 taken along the line II-II, respectively III-III in FIG. 1.
Figure 2B:
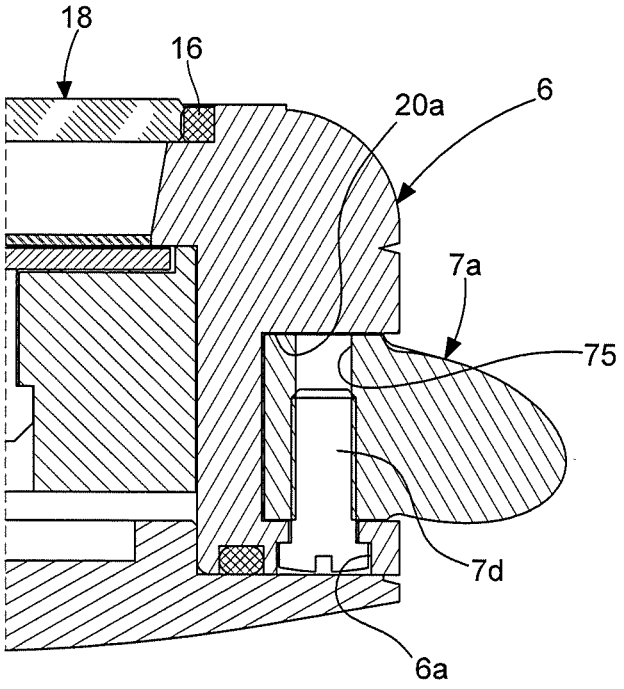

Each strut 7*a*, 7*b* is preferably mounted on a flank of the watch middle 6. To this end, the watch middle 6 comprises for example at least one groove 20*a*, 20*b* to receive a strut 7*a*, 7*b*, recessed in one of its flanks. In the particular embodiment shown in FIGS. 1 to 4, the watch middle 6 comprises two grooves 20*a*, 20*b*. As shown in FIGS. 1 and 2*a* and 2*b*, the depth of each groove 20*a*, 20*b* is such that the corresponding strut 7*a*, 7*b* is accommodated flush with the case in the groove 20*a*, 20*b*. This makes it possible to reduce the costs of machining the watch, whilst enhancing its aesthetic appearance.

The struts 7*a*, 7*b* are disposed on respective opposite sides of the watch middle 6 and are oriented in a longitudinal direction globally corresponding to the direction in which the watch strap 4 extends. The longitudinal direction substantially corresponds to the six o'clock-twelve o'clock direction of the watch case 2 when the watch strap 4 is attached to the watch case 2. As shown in FIG. 1, the struts 7*a*, 7*b* project from the watch middle 6 at six o'clock and twelve o'clock so that they enable attachment of the watch strap 4 to the watch case 2, as described in more detail hereinafter.

A first strut 7*a* of the two struts is attached to the watch middle 6 and is not intended to be detached from the watch middle by the user, as is the second strut 7*b* for reasons that will become apparent hereinafter. To this end, the first strut 7*a* has a central portion pierced at its centre by an opening for the winder crown wheel 11 to pass through. The opening (not shown) is aligned with the orifice in the watch middle 6 so that the winder crown wheel 11 extends through the watch middle 6 and the first strut 7*a*. The latter further comprises, at each of the ends of its part (which is arcuate in the example shown) that comes to be accommodated in the groove 20*a* formed in the flank of the watch middle, a threaded hole 7*c* extending in a direction perpendicular to the plane of the dial 9. Each hole receives a fixing screw 7*d* that passes through a hole 6*a* leading into the groove 20*a* of the watch middle to fasten the strut 7*a* to a right-hand flank of the watch middle 6 (FIG. 2*b*). The right-hand flank is defined as being the flank situated on the side of the right-hand half of the dial 9, considered relative to the six o'clock-twelve o'clock axis of the watch case 2.

A second strut 7*b* is removably fixed to the watch middle 6 via the fixing member 13. The fixing member 13 includes means 24 for detaching the second strut 7*b* from the watch middle 6. The detachment means 24 are configured to enable release of the second strut 7*b* from the watch middle 6 without using tools, as described in detail hereinafter. In the particular embodiment from FIGS. 1 to 4, the fixing member 13 is formed of a crown wheel. The crown wheel 13 comprises a head 26 extended by a fixing rod 28. The head 26 of the crown wheel projects to the outside of the watch case 2 and in this example forms the detachment means 24. The second strut 7*b* has a central portion 22*b* pierced at its centre by an opening 30 through which the crown wheel 13 passes. Such a position of the opening 30 at the centre of the central portion 22*b* of the second strut 7*b* is however in no way limiting in the context of the present invention.

As shown in FIG. 2*a*, the opening 30 is aligned with an opening 32 formed on a left-hand flank of the watch middle 6. The opening 32 receives the fixing rod 28 of the crown wheel 13, allowing firm fixing of the second strut 7*b* against the left-hand flank of the watch middle 6 when the crown wheel 13 is engaged in the watch middle 6, through the second strut 7*b*. In the particular embodiment shown in FIG. 2*a*, the fixing rod 28 is a screw and the opening 32 is an internally threaded opening. In a variant that is not shown, the fixing rod 28 is a bayonet type element and the opening 32 is adapted to cooperate with the bayonet type element to allow fixing of the second strut 7*b* on the watch middle 6.

The shape of the central portion of each strut 7*a*, 7*b* is complementary to that of one of the grooves 20*a*, 20*b* of the watch middle 6, so as to be received in the groove 20*a*, 20*b*. In the watch case 2 taken by way of example in FIGS. 1 to 4, the central portions of the struts 7*a*, 7*b* are of arcuate shape. However, the invention is in no way limited to this kind of shape for the central portions of the struts.

Figure 3:
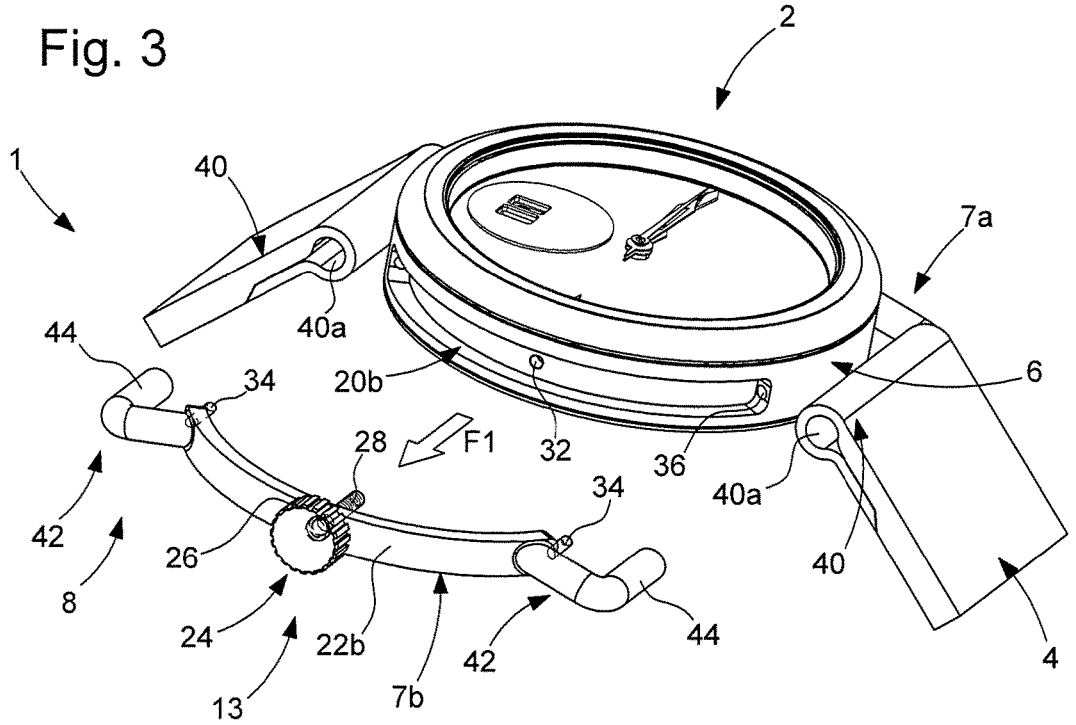
FIGS. 3 and 4 are exploded perspective views of the wristwatch from FIG. 1.
Figure 4:
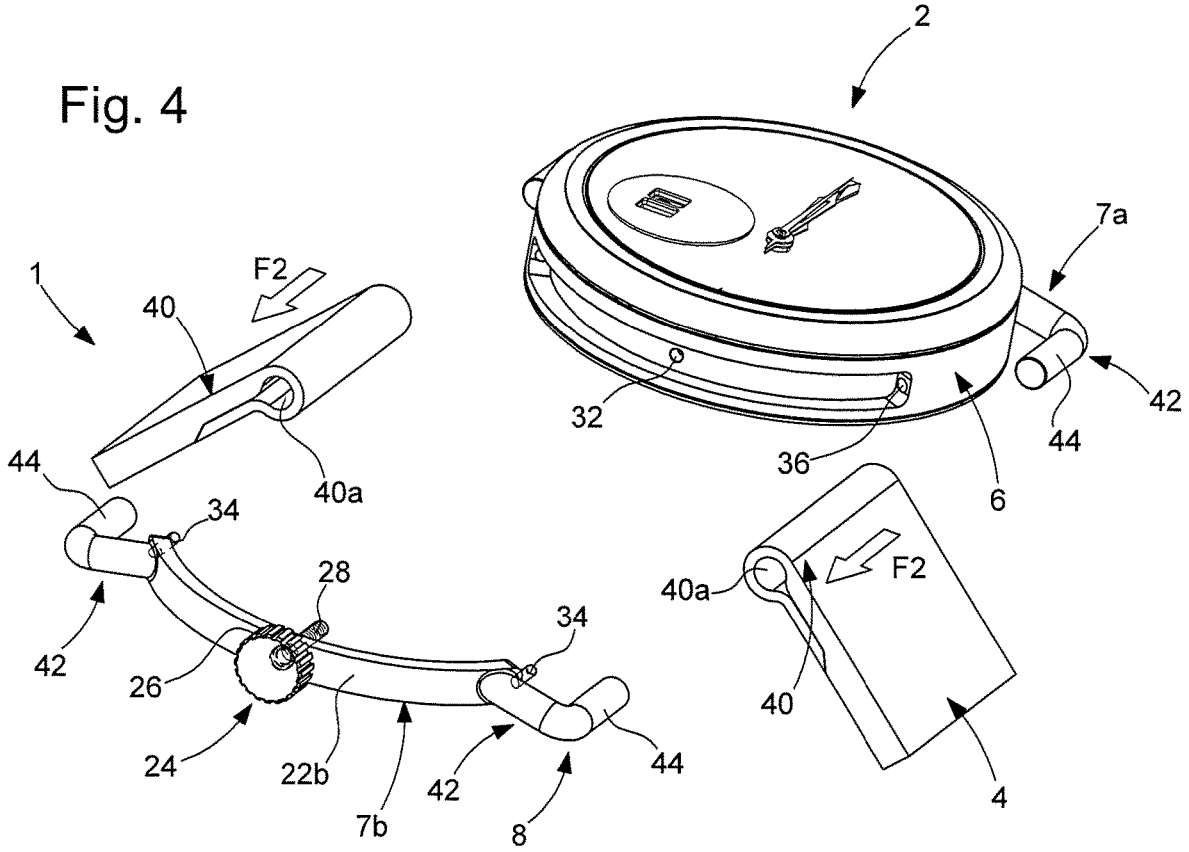

The second strut 7*b* preferably comprises at least one element 34 for guiding and positioning the strut on the watch middle 6, visible in FIGS. 3 and 4. In the particular embodiment shown in FIGS. 1 to 4, the second strut 7*b* comprises two guide and positioning elements 34. Each guide and positioning element 34 is for example formed of a stud projecting from an interior face of the central portion 22*b* of the strut. The watch middle 6 comprises on its left-hand flank, for example in the groove 20*b* formed in that flank, two orifices 36 to receive the elements 34. In the particular embodiment shown in FIGS. 1 to 4, each element 34 is arranged at one end of the central portion 22*b* of the second strut 7*b*, and each receiving orifice 36 is arranged at a corresponding position on the watch middle 6. However, this placing of the elements 34 and the orifices 36, and the number thereof, are in no way limiting in the context of the present invention.

The means 8 for removably attaching the watch strap 4 to the struts 7*a*, 7*b* preferably comprise means 42 for retaining the watch strap 4, inserted in eyelets 40*a* provided in the ends 40 of the watch strap 4 intended to be fixed to the case. In the example shown the watch strap is a flexible watch strap the eyelets 40*a* of which conventionally define a through-passage extending from one lateral edge of the watch strap section to the other, but it goes without saying that according to a variant the passage defining the eyelets 40*a* of the watch strap is not a through-passage provided that its length is adapted to receive the means for retaining the watch strap.

In the particular embodiment from FIGS. 1 to 4, each strut 7*a*, 7*b* includes two end portions in the shape of an "L". According to this embodiment, the retaining means 42 are therefore formed by the end portions in the shape of an "L". Each strut 7*a*, 7*b* is preferably in one piece with its two end portions 42 in the shape of an "L".

Each end portion 42 in the shape of an "L" comprises a pin 44 inserted in the eyelet 40*a* provided in the ends 40 of the watch strap 4. Each pin 44 is substantially parallel to the three o'clock-nine o'clock axis of the watch case 2 when the corresponding strut 7*a*, 7*b* is fixed to the watch middle 6. In this way, each section 40 of the watch strap 4 receives in its eyelet 40*a* two opposite pins 44 each being part of one of the struts 7*a*, 7*b*. This configuration of the pins 44 in the sections 40 therefore provides removable attachment 8 of the watch strap 4 to the struts 7*a*, 7*b*, the attachment 8 being formed when the second strut 7*b* is fixed to the watch middle 6.

As shown in FIG. 1, the opposite pins 44 inside the same eyelet 40*a* of a section of the watch strap 4 have a length such that a small space 46 is formed between the free ends of the pins 44 when the second strut 7*b* is fixed to the watch middle 6 whilst preserving a length of penetration of the pins sufficient to ensure reliable retention of the watch strap 4 on the retaining means when the watch strap 4 is subjected in particular to a traction force along the longitudinal axis of the watch strap. In this regard it will be noted that if the material of the watch strap is flexible the eyelets 40*a* of the watch strap will advantageously be equipped with rigid reinforcing tubes.

The external surface of the pins 44 is preferably treated to obtain a coefficient of friction such that it allows a predetermined clearance of the pins 44 in the eyelets 40*a* of the sections of the watch strap 4. One such treatment is for example obtained via the deposition of a coating layer on the pins 44, this kind of coating layer being for example a layer of polytetrafluoroethylene (PTFE). This makes it possible to facilitate further the operation of fitting and removing the watch strap 4.

The operation of changing the watch strap in the wristwatch 1 comprising the watch case 2 according to the invention is described next with reference to FIGS. 3 and 4.

When a user wishes to detach the watch strap 4 from the watch case 2, for example to change the watch strap, they begin by actuating the means 24 for detaching the second strut 7*b*. In particular, as shown in FIG. 3, the user first unscrews the head 26 of the crown wheel 13, which enables the second strut 7*b* to be disengaged from the groove 20*b* in the direction of the arrow F1. This operation enables the second strut 7*b* to be detached from the watch middle 6. In so doing, the means 8 for removably attaching the watch strap 4 to the struts 7*a*, 7*b* are partly undone, by virtue of the end pins 44 of the second strut 7*b* sliding out of the sections 40 of the watch strap 4.

Then, as shown in FIG. 4, it suffices for the user to slide the watch strap 4 along the end pins 44 of the first strut 7*a* in the direction of the arrows F2 to enable easy extraction of the watch strap 4. The watch strap 4 is then completely detached from the rest of the watch.

The user can then advantageously replace the watch strap 4 with a new watch strap, and then attach the latter to the struts 7*a*, 7*b* by reversing the sequence of operations described above.

The foregoing description of the watch case according to the invention has been given with reference to two struts to support the watch middle. However, this particular number of struts is in no way limiting in the context of the present invention. In particular, according to a variant embodiment that is not shown, the watch case may include only one strut to support the watch middle, which then forms the removable strut.

What is claimed is:

1. A watch case for a wristwatch comprising:

a watch middle;

at least one strut for supporting the watch middle, the strut being rigid and extending beyond the space occupied by the watch middle;

means for removably attaching a watch strap to the strut;

wherein the watch case further comprises a member for fixing the strut or one of the struts to the watch middle, the removable attachment means being formed when said strut is fixed to the watch middle;

wherein said fixing member comprises means for detaching said strut from the watch middle, configured to allow release of the strut from the watch middle without using tools, said strut being removably fixed to the watch middle and wherein the strut is mounted on a flank of the watch middle;

wherein the means for removably attaching a watch strap to the strut comprise means for retaining the watch strap, adapted to be inserted in end sections of the watch strap; and wherein the watch middle further comprises at least one groove to receive a strut, the groove being recessed into a flank of the watch middle, being of complementary shape to a central portion of the strut and receiving said central portion of the strut, the depth of the groove being such that the strut is housed flush in the groove.

2. The watch case according to claim 1, wherein it further comprises a crown wheel comprising a head extended by a fixing rod, the crown wheel forming the fixing member, the head of the crown wheel projecting externally of the watch case and forming the means for detaching the strut from the watch middle.

3. The watch case according to claim 2, wherein the fixing rod is a screw, and wherein the removably fixed strut comprises an opening for the screw to pass through and the watch middle includes an internally threaded opening adapted to receive the screw.

4. The watch case according to claim 2, wherein the fixing rod is a bayonet, and wherein the removably fixed strut comprises an opening for the bayonet to pass through and the watch middle includes an opening adapted to receive the bayonet.

5. The watch case according to claim 1, wherein the watch case is of substantially circular shape, and wherein the strut comprises a central portion of arcuate shape.

6. The watch case according to claim 1, wherein the removably fixed strut further comprises at least one element for guiding and positioning the strut on the watch middle, and wherein the watch middle further comprises at least one receiving orifice adapted to cooperate with said guiding and positioning element.

7. The watch case according to claim 1, wherein the watch case comprises two struts for supporting the watch middle, arranged on respective opposite sides of the watch middle, one of the two struts forming the strut removably fixed to the watch middle, the other strut being attached to the watch middle.

8. The watch case according to claim 2, wherein each strut comprises two L-shaped end portions, each L-shaped end portion of each strut forming one of said retaining means and comprising a pin adapted to be inserted in an end section of the watch strap.

9. The watch case according to claim 8, wherein each strut is in one piece with the L-shaped end portions.

10. A wristwatch comprising:

a watch case and a watch strap attached to the watch case, wherein the watch case comprises:

a watch middle;

at least one strut for supporting the watch middle, the strut being rigid and extending beyond the space occupied by the watch middle;

means for removably attaching a watch strap to the strut;

wherein the watch case further comprises a member for fixing the strut or one of the struts to the watch middle, the removable attachment means being formed when said strut is fixed to the watch middle;

wherein said fixing member comprises means for detaching said strut from the watch middle, configured to allow release of the strut from the watch middle without using tools, said strut being removably fixed to the watch middle and wherein the strut is mounted on a flank of the watch middle, the strut being oriented in the longitudinal direction of the watch strap, the watch strap being removably attached to the strut;

wherein the means for removably attaching a watch strap to the strut comprise means for retaining the watch strap, adapted to be inserted in end sections of the watch strap; and wherein the watch middle further comprises at least one groove to receive a strut, the groove being recessed into a flank of the watch middle, being of complementary shape to a central portion of the strut and receiving said central portion of the strut, the depth of the groove being such that the strut is housed flush in the groove.

11. The wristwatch according to claim 10, wherein the watch strap comprises two end sections, the pin of each L-shaped end portion of each strut being inserted in one of the end sections of the watch strap, said pin being substantially parallel to a three o'clock-nine o'clock axis of the watch case.

12. A wristwatch assembly kit comprising a wristwatch and at least one watch strap, wherein the wristwatch comprises a watch case including:

a watch middle;

at least one strut for supporting the watch middle, the strut being rigid and extending beyond the space occupied by the watch middle;

means for removably attaching a watch strap to the strut;

wherein the watch case further comprises a member for fixing the strut or one of the struts to the watch middle, the removable attachment means being formed when said strut is fixed to the watch middle;

wherein said fixing member comprises means for detaching said strut from the watch middle, configured to allow release of the strut from the watch middle without using tools, said strut being removably fixed to the watch middle and wherein the strut is mounted on a flank of the watch middle;

wherein the means for removably attaching a watch strap to the strut comprise means for retaining the watch strap, adapted to be inserted in end sections of the watch strap, and wherein the watch middle further comprises at least one groove to receive a strut; the groove being recessed into a flank of the watch middle, being of complementary shape to a central portion of the strut and receiving said central portion of the strut, the depth of the groove being such that the strut is housed flush in the groove.

* * * * *